US005609411A

United States Patent [19]

Wang

[11] Patent Number: 5,609,411

[45] Date of Patent: Mar. 11, 1997

[54] INFLATABLE ARTICLE WITH AN ILLUMINATING DEVICE

[76] Inventor: Wen-Ching Wang, No. 15, Fu-Chia Lane, Chen-Nan Rd., Sha-Lu Chen, Taichung Hsien, Taiwan

[21] Appl. No.: 660,577

[22] Filed: Jun. 11, 1996

[51] Int. Cl.[6] ..... F21V 33/00

[52] U.S. Cl. ..... 362/234; 362/253; 362/363; 362/800; 362/806; 473/570; 473/571

[58] Field of Search ..... 446/439, 485; 362/62, 96, 253, 234, 363, 86, 806, 353, 800; 273/65 EF, 58 G

[56] References Cited

U.S. PATENT DOCUMENTS 4,542,445 9/1985 Marletta ..... 362/96

4,997,403 3/1991 Akman ..... 362/96 X 5,066,012 11/1991 Stark ..... 362/253 X

*Primary Examiner*—Stephen F. Husar

*Attorney, Agent, or Firm*—Baker & Botts, L.L.P.

[57] ABSTRACT

An inflatable ball includes a gas tight hollow body and an illuminating device. The device includes a mounting seat body having a base sealingly and integrally bonded to the wall of the hollow body and an inwardly extending light housing which confines a space hermetically sealed from the inflatable space of the body. The base has an opening for access to the space of the mounting seat body and the light housing. A cap is removably provided to close the opening of the base. The illuminating device is received in the space.

12 Claims, 5 Drawing Sheets

INFLATABLE ARTICLE WITH AN ILLUMINATING DEVICE

BACKGROUND OF THE INVENTION

1. Field of the Invention

The invention relates to an article incorporating a illuminating device, and particularly, to an inflatable article, such as a ball or the like, which has an illuminating device.

2. Description of the Related art

It is a common practice to provide illuminating devices inside noninflatable molded plastic articles, such as lanterns, toys or the like, for decoration and amusement purposes. Inflatable articles differ from noninflatable ones in that they require a completely gas tight structure for the prevention of leakage. Consideration of leak proof is necessary if it is desired to install an illuminating device in an inflatable article, such as a volleyball or basketball or the like. The prior art suggests an illuminating device available with an inflatable ball for illuminating the ball at a dark place or where light is insufficient. In this inflatable ball, light emitting elements are provided in a limited space between adjacent surfaces of the ball bladder and the skin of the ball so that light is produced in the form of spots. Illumination as such is insufficient for identification of the ball or the moving direction thereof. In case the quantity of the light emitting elements is to be increased in an attempt to illuminate the whole surface of the ball, a wiring system has to be designed to match the construction of the bladder for electrical connection among the increased number of light emitting elements. To avoid such a complicated construction, it is desirable to develop an illuminating device which can be placed inside an inflatable article to illuminate the whole body thereof.

SUMMARY OF THE INVENTION

The primary objective of the invention is to provide an inflatable article with an illuminating device that can be mounted inside the article without impairing the gas tightness of the article.

Another objective of the invention is to provide an illuminating device having components that can be removed from the interior of an inflatable article for replacement or maintenance.

According to one aspect of the invention, an inflatable article comprises a gas tight hollow body having a rounded wall enclosing a first space, and an illuminating device mounted inside the hollow body and occupying a portion of the first space. The device includes containing means which has a base sealingly and, integrally bonded to the rounded wall and which confines a second space hermetically sealed from the remaining portion of the first space. The base has at least a part exposed from the rounded wall and an opening formed in the exposed part for access to the second space. A cap is removably provided to close the opening of the base. The device further includes electric circuit means which is received in the second space and which comprises a light emitting element and a power source.

In one embodiment of the invention, the containing means comprises a mounting seat body which is integrally formed with the base, and a light housing which is sealingly and integrally coupled to the mounting seat body and which is located opposite to the base. The mounting seat body has a cavity which is communicated with the interior of the light housing to define the second space wherein the cavity receives the power source while the light housing receives the light emitting element.

The mounting seat body may be made of rubber and the light housing may be made of plastic. Alternatively, the mounting seat body and the light housing may be integrally formed with the rounded wall of the gas tight hollow body by using the same material.

The light emitting elements may be light emitting diodes. The electric circuit means may further comprises a sound amplifying unit and a switch responsive to the movement of the gas tight hollow body for energizing the electric circuit.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
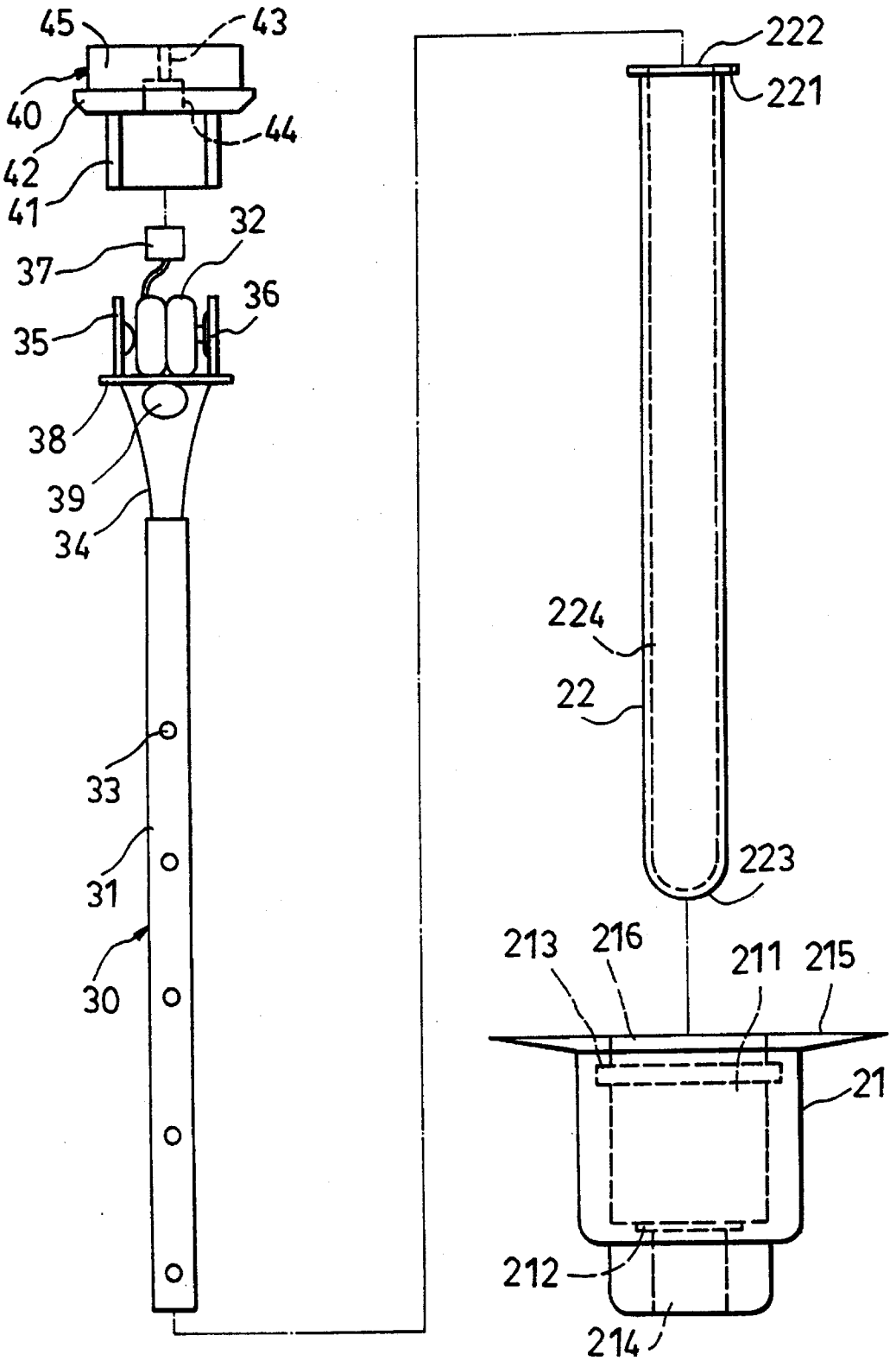
FIG. 1 is an exploded view illustrating a first embodiment of the present invention wherein the rounded wall of the hollow body of the inflatable article is omitted.
Figure 2:
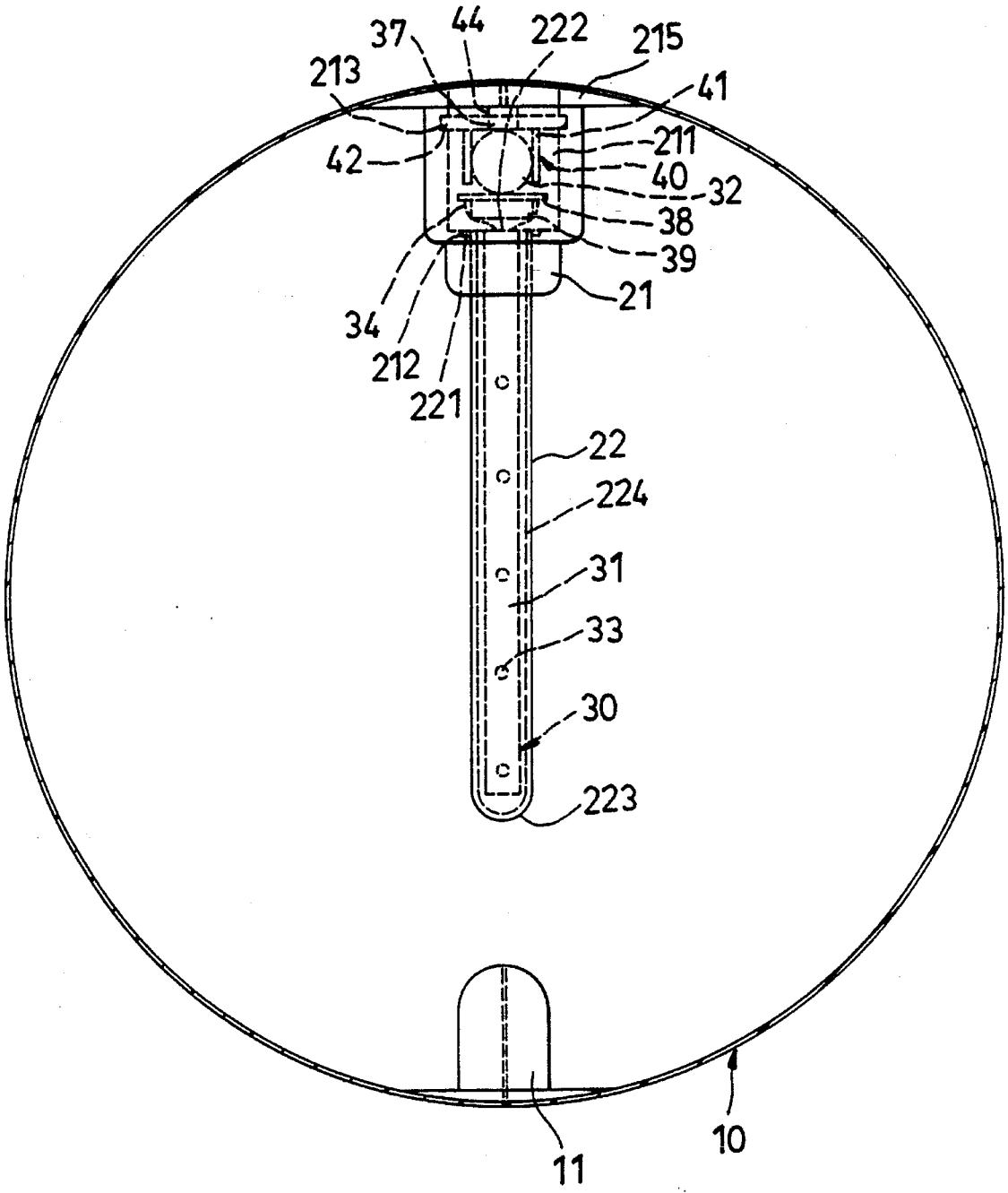
FIG. 2 is a plan view illustrating the first embodiment including the rounded wall.

In FIGS. 1 and 2, a ball bladder is shown as a first preferred embodiment of the present invention, which comprises a gas tight ball-shaped hollow body 10 having an inflating valve 11 and an illuminating device mounted inside the hollow body 10 opposite to the inflating valve 11. The illuminating device comprises a mounting seat body 21, a light housing in the form of a tube 22 integrally coupled to the mounting seat body 21, and an electric circuit provided inside the mounting seat body 21 and the tube 22.

The mounting seat body 21 is made of rubber and is integrally bonded to the wall of the gas tight hollow body 10 during molding the hollow body 10. The mounting seat body 21 has a base 215, a cavity 211 and a bore 214 with a cross-section smaller than that of the cavity 211. A first annular groove 212 is formed in the mounting seat body 21 between cavity 211 and bore 214 and a second annular groove 213 is formed adjacent to the base 215. The base 215 is exposed from the wall of the hollow body 10 and has an opening 216 for access to the cavity 211.

The tube 22 is made of a light transmittable plastic material. The tube 22 is securely fixed in the bore 214 of the mounting seat body 21. Since the mounting seat body 21 is made of rubber, the tube 22 is pinched in the bore 214 sealingly. The tube 22 has a closed end 223 and an open end 222 formed with an annular flange 221. The annular flange 221 of the tube 22 is tightly received in the annular groove 212 of the mounting seat body 21.

Figure 2A:
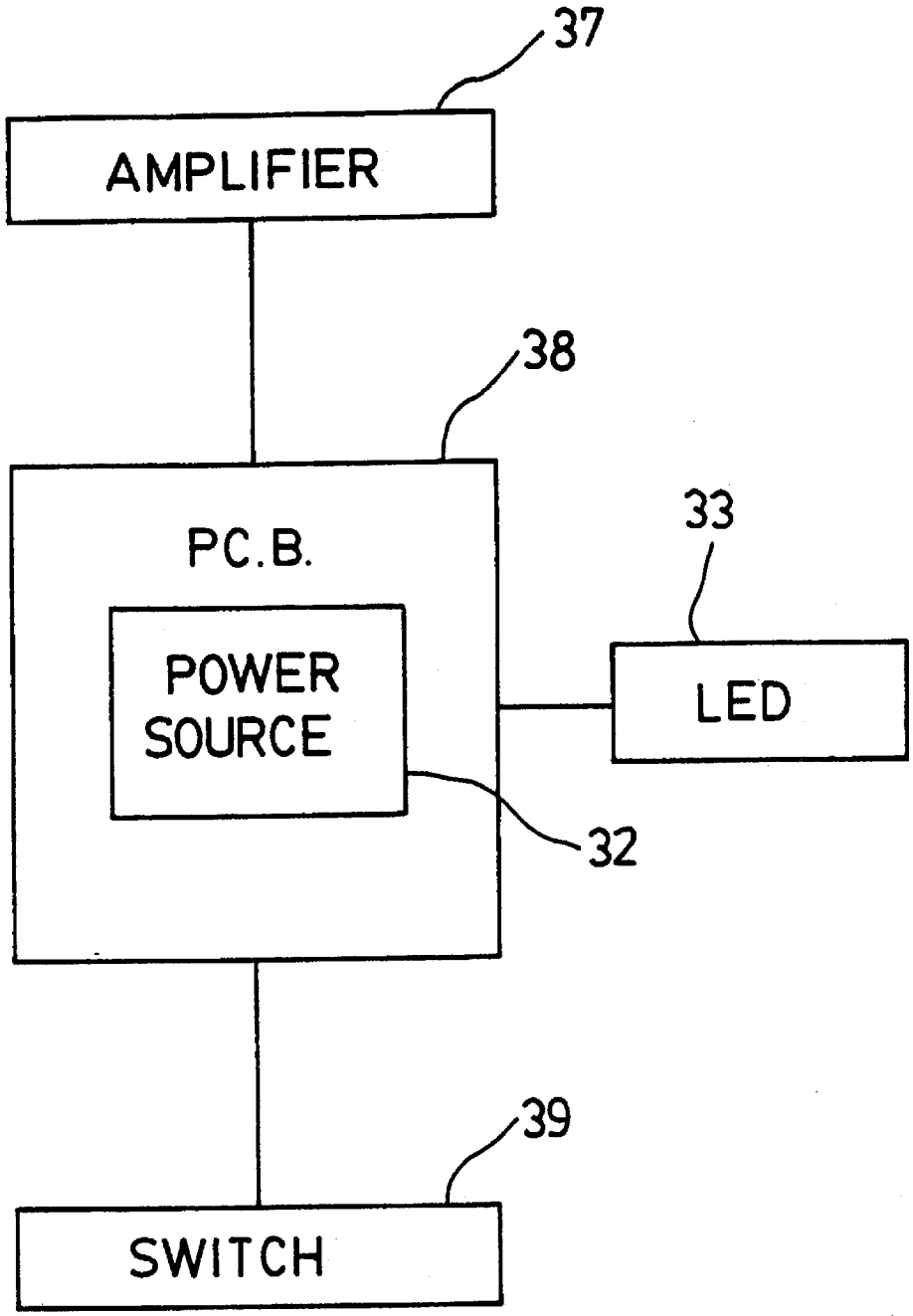
FIG. 2A shows a block diagram of the electric circuit of the illuminating device of the invention.

Referring to FIG. 2A in combination with FIGS. 1 and 2, the electric circuit comprises an illuminating body 30 which is inserted into the tube 22 via the opening 216 in the mounting seat body 21. The illuminating body 30 includes an elongated circuit board 31 on which are mounted a plurality of light emitting elements 33 such as LEDs which are electrically connected in series. Mercury cells 32 are mounted on a printed circuit board 38 as a power source. Two conductors 34 extending from the circuit board 31 are respectively connected to a positively charged electrode 35 and a negatively charged electrode 36 of the mercury cells 32. The circuit board 31 is further connected to a sound amplifying unit 37 and a switch 39 which is of a type responsive to the movement of the hollow body 10. The switch 39 as embodied herein is a mercury switch which can place the electric circuit in an ON state when the hollow body moves or bounces.

A cap 40, made of rubber, is used to sealingly close the opening 216 in the mounting seat body 21. The cap 40 has an inner annular insert portion 41 extending into the cavity 211 of the mounting seat body 21, an outer portion 45 extending outwardly of the base 15 of the mounting seat body 21, and an annular projection 42 formed between the outer portion 45 and the inner annular insert portion 41. The inner annular inset portion 41 surrounds the electrodes 35 and 36 and the cells 32. The annular projection 42 is in press fit in the second annular groove 213 of the mounting seat body 21. A recess 44 is formed in the cap 40 to receive the sound amplifying unit 37 and a plurality of sound holes 43 are provided adjacent to the recess 44.

In the manufacture of the ball bladder of this embodiment, the base 215 of the mounting seat body 21 is preformed and then integrally bonded to the wall of the hollow body 10 of the bladder when the bladder is formed in a mold. In assembly, the tube 22 is placed in the hollow body 10 by passing the same through the opening 216 in the base 215 of the mounting seat body 21. The portion of the tube 22 adjacent to the open end 222 is applied with an adhesive and is press fitted in the first annular groove 212 and the bore 214, thereby sealingly and securely fixing the tube 22 to the mounting seat body 21. The illuminating body 30 is inserted into the space 224 of the tube 22 via the opening 216 in the mounting seat body 21 and the open end 222 of the tube 22. When the cap 40 closes the opening 216 in the mounting seat body 21, the annular insert portion 41 of the mounting seat body 40 surrounds the electrodes 35 and 36, and the recess 44 receives the sound amplifying unit 37. This arrangement immobilizes the electrodes 35 and 36, the cells 32, and the sound amplifying unit 37. The annular projection 42 of the cap 40 is tightly fitted in the second annular groove 213 in the mounting seat body 21.

In application, the ball bladder of this embodiment is used with a shell of a ball. When the ball bounces or moves due to an external force, the switch 39 is moved to an ON state which energizes the electric circuit and the light emitting diodes 33. As a result, the light emitting diodes 33 illuminate the whole body of the ball. In order to save electricity, a manually operable switch (not shown) may be additionally provided at the exterior of the hollow body 10 so as to turn on or off the electric circuit manually when the ball is not used. With this additional switch, the electric circuit can be turned off desirably so that any movement caused by a change in the position of the ball does not energize the electric circuit. The sound amplifying unit 37 functions to amplify the sounds generated upon impacts induced by the impinging of the ball.

In addition to the advantageous effects of immobilizing the components of the electric circuit means against damaging impact forces, the construction as mentioned above also permit removal of the components from the hollow body 10 of the bladder for replacement and repair by detaching the cap 40 from the mounting seat body 21.

Figure 3:
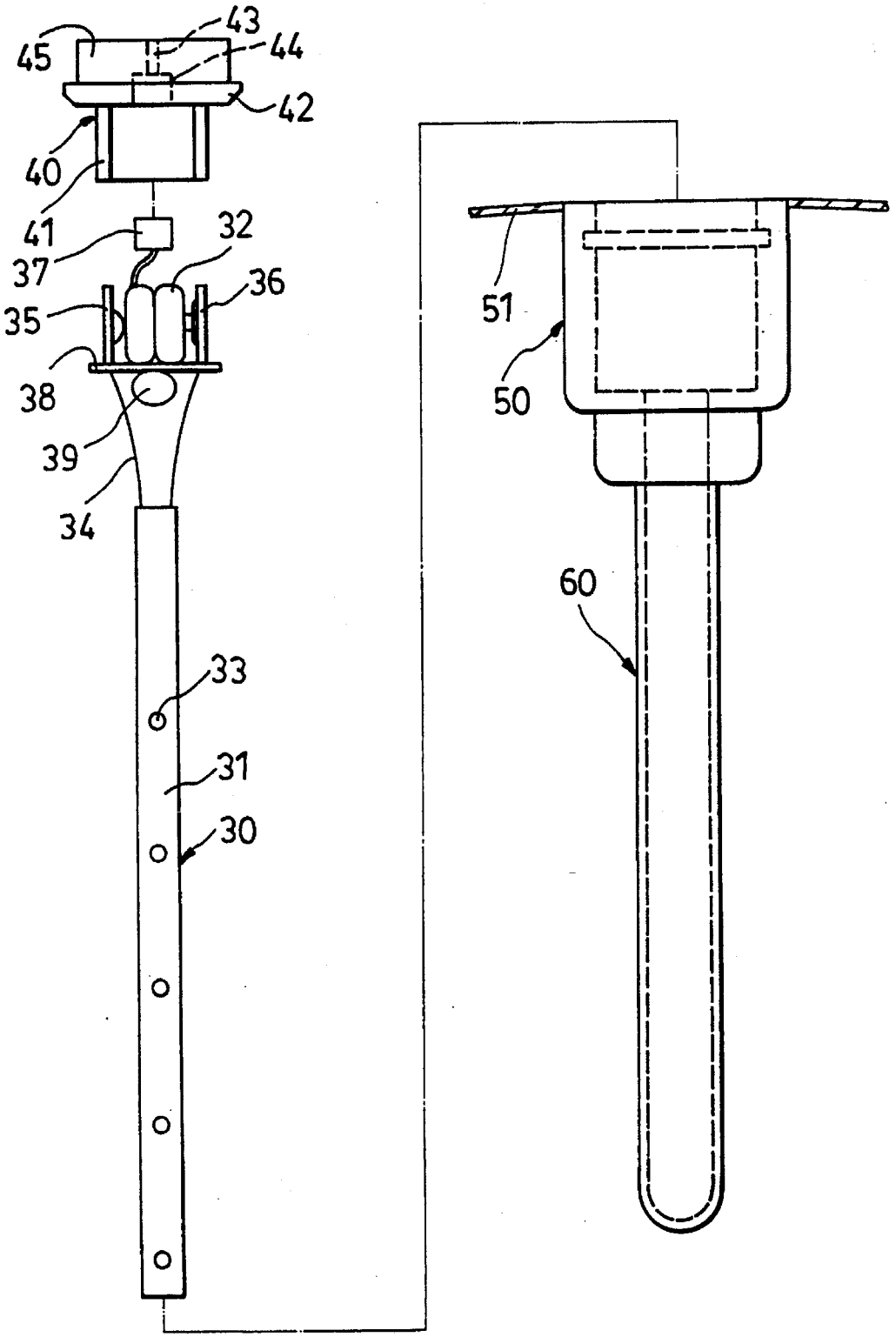
FIG. 3 is an exploded view illustrating a second embodiment of the invention wherein the rounded wall is omitted.

FIG. 3 shows a second embodiment of the invention, wherein elements similar to those of in the first embodiment are denoted by like reference numerals. The construction of the second embodiment is substantially the same as that of the first embodiment except that a mounting seat 50 and a tube 60 of the second embodiment are preformed integrally and are bonded to the wall 51 of an inflatable ball by spin welding with the use of the same material such as PVC.

Figure 4:
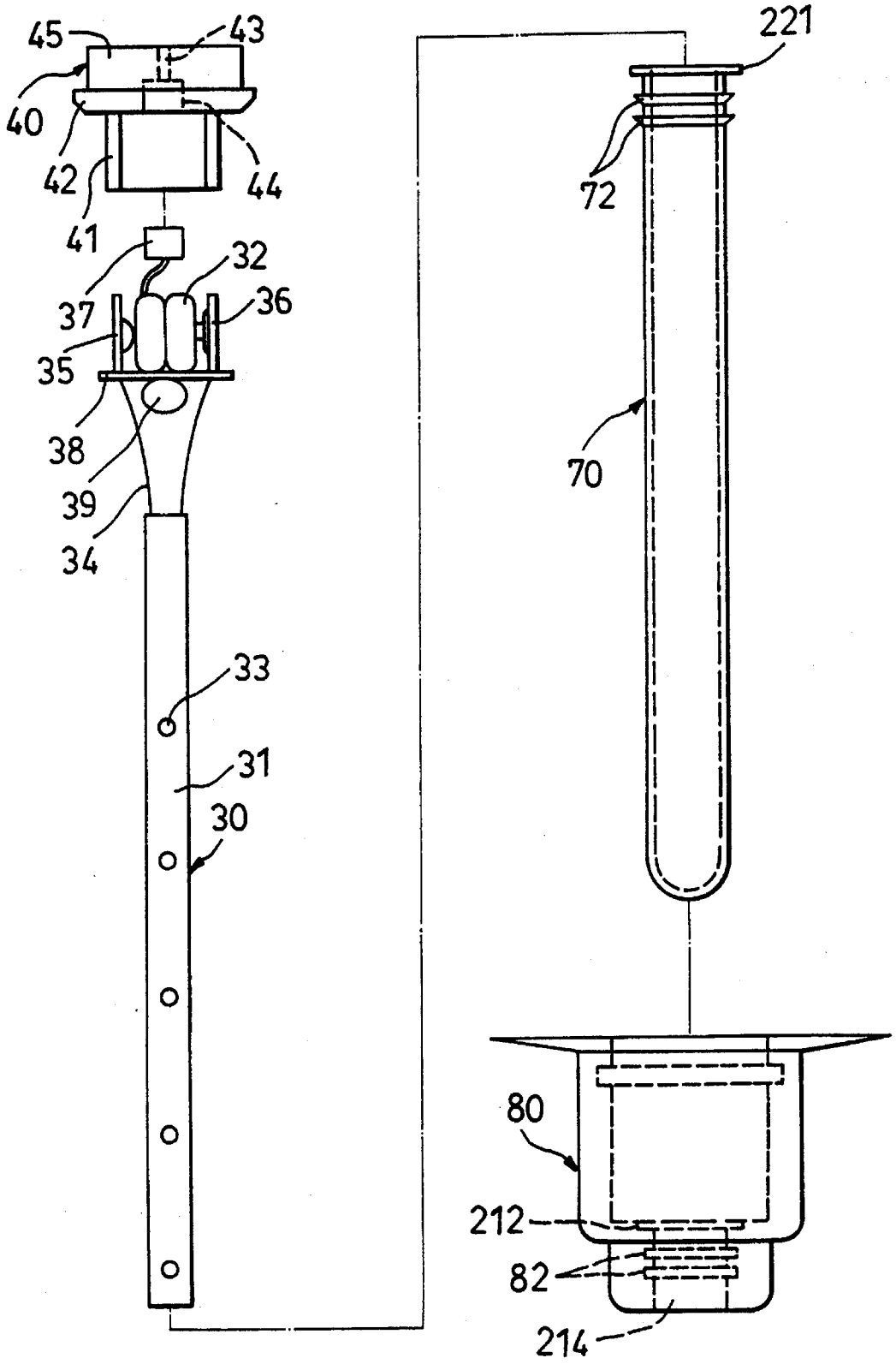
FIG. 4 is an exploded view illustrating a third embodiment of the invention wherein the rounded wall is omitted.

FIG. 4 shows a third embodiment of the present invention, wherein elements similar to those of the first embodiment are denoted by like reference numerals. The third embodiment of the present invention differs from the first embodiment in that the mounting seat body 80 of the third embodiment has additional annular grooves 82 below an annular groove 212 and that the tube 70 has additional annular flanges 72 for engagement with the annular grooves 82. The interengagement of the annular flanges 72 and the annular grooves 82 provides additional gas sealing effect between the rubbery mounting seat body 80 and the plastic tube 70.

While the present invention has been described in connection with what is considered the most practical and preferred embodiments, it is understood that this invention is not limited to the disclosed embodiments but is intended to cover various arrangement included with the spirit and scope of the broadest interpretations and equivalent arrangements.

I claim:

1. An inflatable article comprising:

a gas tight hollow body having a rounded wall which encloses a first space; and an illuminating device mounted inside said hollow body and occupying a portion of said first space, said device including containing means which has a base sealingly and integrally bonded to said rounded wall and which confines a second space hermetically sealed from remaining portion of said first space, said base having at least a part exposed from said rounded wall and an opening formed in said part for access to said second space, said device further including electric circuit means received in said second space, said electric circuit means including a light emitting element and a power source; and a cap for removably closing said opening in said base.

2. An inflatable article as claimed in claim 1, wherein said containing means comprises a mounting seat body which is integrally formed with said base, and a light housing which is sealingly and integrally coupled to said mounting seat body and which is located opposite to said base, said mounting seat body having a cavity which is communicated with the interior of said light housing to define said second space, said cavity receiving said power source, said light housing receiving said light emitting element.

3. An inflatable article as claimed in claim 2, wherein said light housing is formed as a tube.

4. An inflatable article as claimed in claim 3, wherein said mounting seat body is made of rubber and has one end to be sleeved on said light housing, said tube being made of plastic and being capable of passing through said opening and said cavity, said tube having an open end to be tightly fitted in said one end of said mounting seat body.

5. An inflatable article as claimed in claim 4, wherein said tube has at least one annular flange at said open end, said mounting seat body having a first annular groove to tightly receive said annular flange.

6. An inflatable article as claimed in claim 2, wherein said light emitting elements are light emitting diodes.

7. An inflatable article as claimed in claim 2, wherein said electric circuit means further comprises a switch for energizing said electric circuit in response to movement of said gas tight hollow body.

8. An inflatable article as claimed in claim 2, wherein said electric circuit means further comprises a sound amplifying unit.

9. An inflatable article as claimed in claim 3, wherein said electric circuit means further comprises an elongated first printed circuit board which extends longitudinally into said tube, a second printed circuit board which is received in said cavity, and a pair of electrodes spacedly installed on said second printed circuit board, said light emitting elements being mounted on said elongated first printed circuit board, and said power source including dry cells mounted between said pair of electrodes.

10. An inflatable article as claimed in claim 2, wherein said mounting seat body further has a second annular groove adjacent to said base, said cap having an inner annular insert portion extending into said cavity to surround said electrodes and said dry cells, an outer portion extending outwardly of said base, and an annular projection between said outer portion and said annular insert portion, said annular projection being tightly received in said second annular groove of said mounting seat body.

11. An inflatable article as claimed in claim 10, wherein said electric circuit means further has a sound amplifying unit, said cap further having a recess to receive and position said sound amplifying unit.

12. An inflatable article as claimed in claim 2, wherein said mounting seat body, said light housing and said rounded wall of said gas tight hollow body are made from the same material.

* * * * *